United States Patent [19]

Vandergriff

[11] Patent Number: 4,974,294

[45] Date of Patent: Dec. 4, 1990

[54] COTTON GIN SEED VANES AND SEED ROLL BOX

[75] Inventor: Arvel L. Vandergriff, Visalia, Calif.

[73] Assignee: Consolidated H.G.M. Corporation, Lubbock, Tex.

[21] Appl. No.: 349,596

[22] Filed: May 9, 1989

[51] Int. Cl.[5] ..... D01B 1/08

[52] U.S. Cl. ..... 19/62 R; 19/48 R

[58] Field of Search ..... 19/55 R, 62 R, 62 A, 19/63

[56] References Cited

U.S. PATENT DOCUMENTS

| | | | |
|---|---|---|---|
| 13,641 | 10/1855 | Fultz | 19/55 R |
| 26,604 | 12/1859 | McLendon | 19/55 R |
| 84,392 | 11/1868 | Sutton | 19/55 R |
| 167,679 | 9/1875 | Massey | 19/55 R |
| 484,906 | 10/1892 | Browne | 19/55 R |
| 825,818 | 7/1906 | Gardner | 19/62 R |
| 1,105,026 | 7/1914 | Fordyce et al. | 19/62 A |
| 1,460,228 | 9/1921 | Compston | 19/62 A |
| 4,310,949 | 1/1982 | Vandergriff | 19/62 R |
| 4,313,242 | 2/1982 | Salmon | 19/55 R |

*Primary Examiner*—Werner H. Schroeder
*Assistant Examiner*—Michael A. Neas
*Attorney, Agent, or Firm*—Wendell Coffee

[57] ABSTRACT

A method and apparatus for accelerating the removal of fully ginned seed from a seed roll established in the roll box of an operating gin stand, whereby the capacity of the stand is enhanced. The apparatus is characterized by a set of vanes attached to a finger shaft, said finger shaft being rotatable to change the angle of projection of the vanes to control the residual lint on the seed. The vanes are located so as to project into a vertical seed discharge shaft as the seed roll sags in its rotation toward the saws. The vanes are spaced to permit the seed roll to rupture as it passes over the vanes and the roll sags into the gap between the vanes, thus releasing fully ginned seed into the seed discharge shaft outside the surface of the saw between the vanes.

6 Claims, 2 Drawing Sheets

COTTON GIN SEED VANES AND SEED ROLL BOX

B. CROSS REFERENCE TO RELATED APPLICATION

None.

C. RIGHTS TO INVENTIONS UNDER FEDERAL RESEARCH

There was no federally sponsored research and development concerning this invention.

D. BACKGROUND OF THE INVENTION (1) Field of the Invention

This invention relates to ginning seed cotton. Builders of cotton gins have ordinary skill in this art.

(2) Description of the Related Art

The invention relates to an improved method and apparatus for removing seeds from a roll box of an operating gin stand at an accelerated rate, whereby the indigenous density of seed rolls is reduced and capacity of ginning stands is increased.

As is well understood by those familiar with the design and operation of the so called saw type cotton gin, a gin stand consists of a plurality of coaxially spaced saw blades or discs mounted in mutually spaced relation on a driven shaft and having projected there between elongated seed roll support members, commonly referred to as ginning ribs, or, more conveniently, ribs. The teeth of the saw blades extend between the ribs and engage the fibers of seed cotton as it is fed to the gin stand. The fibers are, in turn, pulled through ginning gaps, defined by the adjacent ribs, while passage of the seeds is precluded. The thus rejected seeds, along with fibers not engaged by the teeth, tend to accumulate in a comingled cohesive mass to establish a seed roll which is continuously rotated in response to the action of the saw blade action thereon. The seed roll is confined by head plates and scrolls which collectively form a cavity, commonly referred to as a roll box. The seed roll will basically consist of a center of ginned seed surrounded by a covering of seed cotton and lint. Of course, the lint or fibers carried by the blades through the ribs, is doffed or removed from the teeth and delivered to subsequent stations at which additional operations are performed.

The preferred diameter of the saw blades in my gin is 12" with a thickness of 0.045". The teeth are die cut with the leading edge straight and tangent to a circle with a radius of 4" and whose center is common to the center of the saw. The preferred speed of the saw is 800 to 850 rpm.

Currently, it is common practice to adjust the ginning rate of a gin stand to the discharge rate for ginned seed, rather than the rate the lint removal by the saw teeth occurs. The normal contours before this invention of the ginning rib and scrolls forming the roll box cavity limit the seed discharge rate for reasons which will be explained later. With this limitation, as the rate of flow of unginned cotton into the roll box is increased, the population of ginned seeds in the seed roll increases. Unless the seed discharge rate can be increased to match the inflow and the rate of lint removal, the density of the seed roll increases to the point that the disc brake effect of the mass against the saw blades increases the power consumption beyond a practical level.

When a gin stand is put into operation with an empty seed roll cavity, the cotton fibers are engaged by the saw teeth and are carried, along with the seed to which they are attached, to the rib gap where the seed are rejected. The fibers engaged firmly by the teeth pass between the ribs, or through the rib gap where they are doffed and conveyed by the doffing air to the next process. There is always a mass of fibers pulled from the seed and not firmly attached to the saw teeth, but are pulled into the rib gap. As additional loose fibers are pulled into the gap and accumulate ahead of the saw teeth, the mass is pushed upward in the gap between the ribs. It is this upward or forward movement of the fibers in the gap that starts the rotation and formation of the seed roll. To begin with, the seed roll is a comingled mass of seed in various stages of lint removal.

At the point where the saw blade enters the rib gap the rib spacing is narrow, with a gauge of 0.110" to 0.125". In order for the loose fibers which are pulled into the gap to move freely up the gap between the ribs, the gap must gradually widen to form a tapered opening. The upper section of the gap must be wide enough to permit all the loose fibers to be pulled back into the seed roll.

As the ginning action continues with the seed roll rotating, the ginned seed work their way to the core of the seed roll where they accumulate. The core builds until the ginned seed reach the surface where they mix with the incoming cotton. The established seed roll will basically consist of a cohesive mass with a center of ginned seed surrounded by this layer or covering of seed cotton and lint. As the seed roll approaches the saw, its surface is permitted to sag into the seed passage and the ginned seed are loosened, and discharge down the seed passage. Of course the saw penetrates the roll surface and releases seed to fall between the saws.

Before combing lint cleaners came into general use, the gin stand capacity was limited to a loose roll, or low density, because if the lint was packed tightly into the saw teeth the fibers would be kinked after doffing, and this condition resulted in the classer lowering the grade due to what was called "rough preparation". The price was penalized severely because these kinked groups of fibers dropped out as waste in the mill processing.

In the very early development of saw ginning, the manufacturers found that a saw spacing in the range of ¾", along with very little sag in the seed roll into the seed passage would, with dry cotton, operate with a loose roll and discharge seed with low residual lint. Sometime in the mid 1800's, when it was found that cotton seed had some value, means to separate trash from the cotton as it entered the gin was introduced by having the saw drag it between huller ribs on its way into the seed roll. This limited the saw spacing to about ¾" because the unginned cotton would not pass between ribs with closer spacing.

After the introduction of combing lint cleaners, which are almost universally used today, the gin stand no longer had to produce a smooth sample. The lint cleaners would comb out the kinks. This opened up new possibilities for increasing the production rate of the gin stand. This was first done by merely feeding more cotton in the unit and letting it operate with a higher density seed roll. This higher density forced more fibers into the saw teeth, thus removing more lint per saw blade. It was slowly learned that an improved ginning rate, since, with the higher density seed roll, the lint could be removed from the seed at a greater rate than the seed were being discharged. It was necessary to adjust the rate of feed to that of the seed discharge rate.

The contour of the gin rib and the seed roll scrolls were rather sacred, having been developed over a period beginning with the 1796 Holmes Gin. The first real effort to change the roll box contour to improve seed discharge, to take advantage of this higher rate of seed discharge was made by this applicant in the early 1960's. This basically amounted to having the seed roll in its rotation, approach the saw at a steeper angle to increase the sag of the roll as it passed over the seed passage. This caused a more drastic rupture of the seed roll surface, thus releasing the ginned seed that were on and near the surface of the roll. This was very effective and became a very popular gin stand conversion. These are still being sold over 20 years later.

Another step in improving the gin stand production rate was the use of a rotating cylinder in the core of the seed roll to increase the pressure of the seed roll mass against the saw to more thoroughly load the saw teeth, thus increasing the rate of lint removal. One such rotating cylinder consisted of a series of discs with serrated edges mounted on a tube or shaft at an angle so that they wobbled as they rotated. This along with the proper roll box contour was an effective means of applying the unginned seed to the saw teeth. This device is the subject of U.S. Pat. No. 3,091,001, which the applicant is co-patentee.

The applicant later introduced a method of removing the ginned seed through a perforated metal tube located in the core of the seed roll (U.S. Pat. No. 4,310,949). The tube also served to a great extent, the same purpose of increasing the pressure of the seed roll mass against the saw teeth, as did the rotating cylinder with discs as mentioned above.

These developments resulted in the reverse situation which were faced earlier, wherein the seed could be removed faster than the lint removal capacity. The next approach then was to increase the lint removal rate, by spacing the saws closer together. Although this did not necessarily increase the per saw capacity, it did result in an increase in per unit capacity. The same spacing is now reduced from $\frac{3}{4}''$ (0.75″) mentioned to 9/16″ to $\frac{5}{8}''$(0.58″).

E. SUMMARY OF THE INVENTION (1) Progressive Contribution to the Art

This closer spacing suggested a wider seed passage which would permit a more drastic rupture of the surface of the seed roll and, thus an increase rate of ginned seed release. The seed passage was widened by changing the contour of the ginning rib, moving the rib back from the surface of the saw blades. This increased the seed discharge rate but it was still possible to remove the lint at a rate greater than the seed discharge rate. By removing the huller ribs, the lower front of the roll box can be moved away from the surface of the saw to further widen the seed passage or seed discharge shaft. However, this approach is limited since the seed roll surface under pressure will sag too deeply and extrude chunks of its surface through the passage. These chunks contain partially ginned seed.

My present invention eliminates the extrusion problem by placing vanes or pins or fingers on a finger shaft, said vanes projecting into the seed passage or discharge shaft, and are spaced to permit the seed roll to sag between them sufficiently to rupture its surface and release the ginned seed.

The finger shaft and vanes are located externally in the same position of the seed finger whose purpose was to control the seed discharge rate by controlling the sag of the seed roll surface into the seed passage. However, the prior art seed fingers were spaced the same as the saw and no seed discharged between them. The finger shaft containing the vanes is mounted to be rotated in the same manner as the old seed fingers were, but are spaced at least three saw spacing apart and permit seed roll rupture instead of restricting it.

One important feature of this invention is that the seed which discharges between these vanes fall free of the surface of the saws through the discharge shaft, not between the saws which restricts their flow.

(2) Objects of this Invention

An object of this invention is to gin cotton.

Further objects are to decrease the time required to gin a bale of cotton.

Further objects are to achieve the above with devices that are sturdy, compact, durable, lightweight, simple, safe, efficient, versatile, ecologically compatible, energy conserving, and reliable, yet inexpensive and easy to manufacture, connect, adjust, operate and maintain.

Other objects are to achieve the above with a method that is rapid, versatile, ecologically compatible, energy conserving, efficient, and inexpensive, and does not require highly skilled people to connect, adjust, operate, and maintain.

The specific nature of the invention, as well as other objects, uses, and advantages thereof, will clearly appear from the following description and from the accompanying drawing, the different views of which are not scale drawings.

F. BRIEF DESCRIPTION OF THE DRAWINGS

Figure 1:
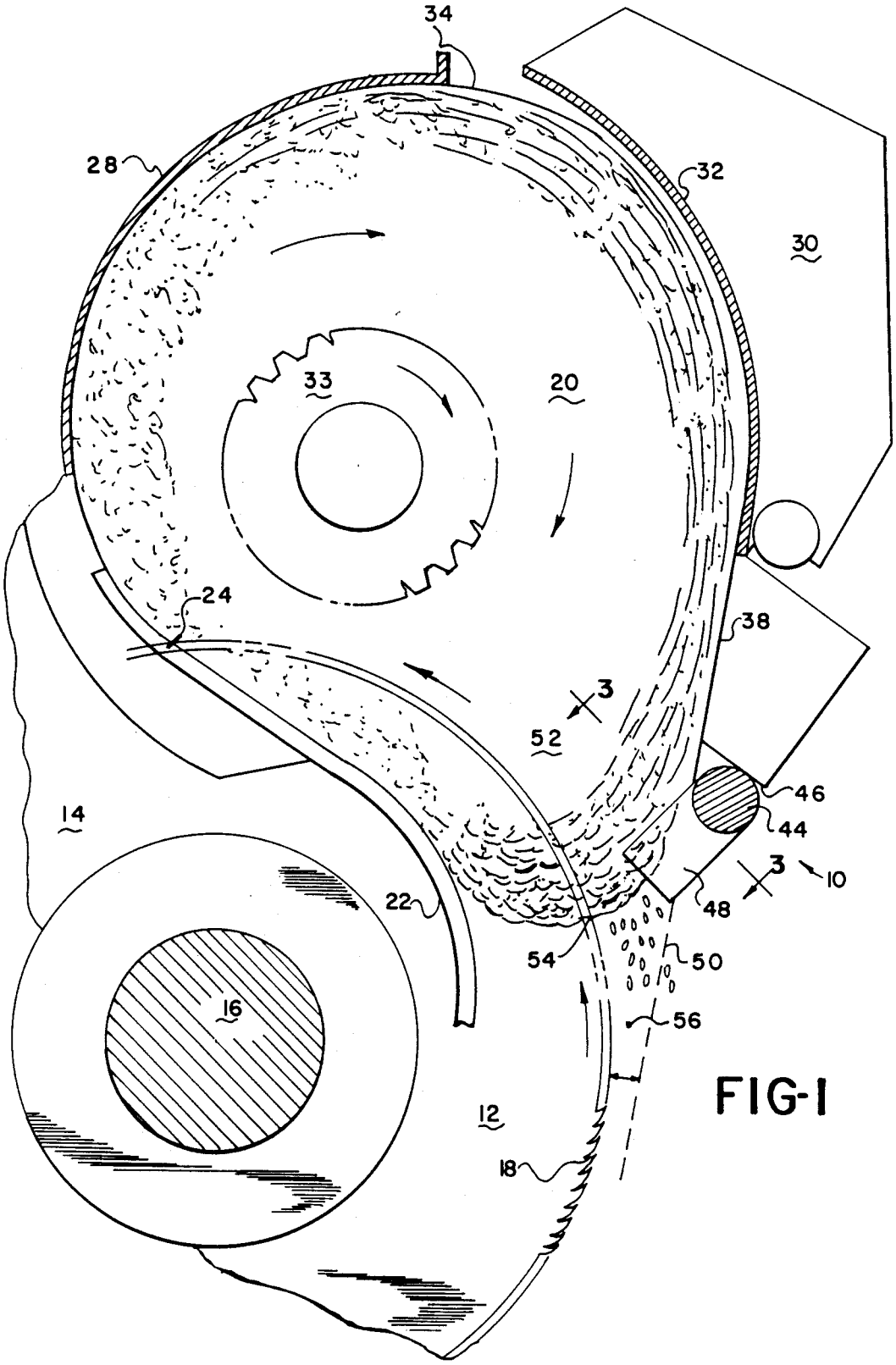
FIG. 1 is a somewhat schematic representation of a partial cross-section of a cotton gin stand according to this invention.
Figure 2:
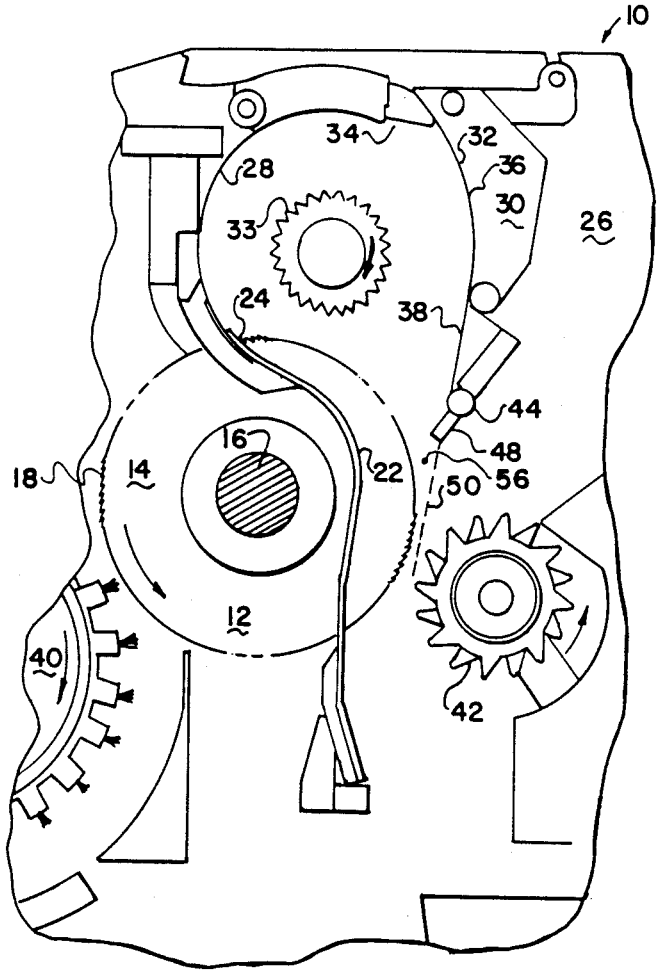
FIG. 2 is a simplified cross-sectional partial view of the structure of the cotton gin stand of FIG. 1.
Figure 3:
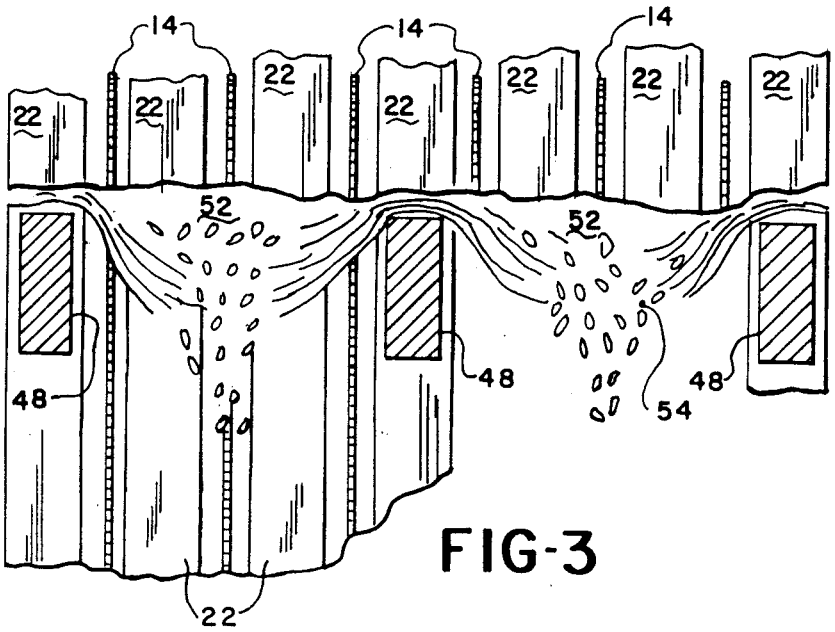
FIG. 3 is a somewhat schematic representation of the seed roll and related structure with the seed roll rupturing between the fingers taken substantially on line 3—3 of FIG. 1.

As an aid to correlating the terms of the claims to the exemplary drawing, the following catalog of elements is provided:

10 stand
12 saw cylinder
14 saw disc
16 saw shaft
18 teeth
20 seed roll
22 gin ribs
24 ginning point
26 inlet box
28 back scroll
30 door
32 door scroll
33 agitator
34 gap
36 arcuate portion
38 plane surface
40 doffer brush
42 picker roller
44 finger shaft
46 bottom edge
48 vanes 50 plane surface extension
52 lobe
54 bight
56 seed discharge shaft

G. DESCRIPTION OF THE PREFERRED EMBODIMENT

Referring to the drawings, there may be seen represented a cotton gin stand 10. The stand will have a front, back, top, and bottom orientation. A principle component of the stand is saw cylinder 12. The cylinder includes a plurality of saw discs 14 closely spaced together upon saw shaft 16. The shaft is journaled for rotation about its axis which is horizontal. The saw discs are circular as is the cylinder 12. Each saw disc 14 has teeth 18 along the perimeter of the disc. The teeth 18 define the surface of the saw cylinder 12. Seed roll 20 is formed within the seed roll box. The seed roll box has structure formed of several components. The gin ribs 22 form a portion of the structure which forms part of the bottom and back of the seed box. The point where the teeth 18 pass between adjacent ribs 22 is ginning point 24. The back of the roll box will be formed by back and top scroll 28. The inside of door 30 will have door scroll 32 which forms a portion of the structure forming the front of the seed box. Normally there is a gap 34 between the back scroll 28 and door scroll 32.

As previously described, it is often desirable to have a rotating agitator 33 near the center of the seed roll.

Also, the gin stand 10 will include doffing brush 40 to doff the cotton from the saw teeth 18. Also, there will be picker roller 42 at the bottom of inlet box 26 to pitch the incoming cotton onto the saw teeth 18.

Basically, the structure described to this point is old, well known, and has been commercially on the market for many years. According to this invention, there are no huller ribs as are found in almost all gin stands at the present time.

According to this invention, finger shaft 44 is located along bottom edge 46 of plane surface 38 of the door 30. A plurality of vanes 48 are attached to the finger shaft 44. The finger shaft is mounted for adjustable rotation about its axis so that the exact angle of the vanes 48 may be adjusted.

According to this invention, the plane surface 38 angles toward the surface of the saw cylinder 12. The plane surface 38 will be tangent to arcuate portion 36 of the scroll 32. If a straight line 50 is extended from the plane surface 38, this extension 50 would be spaced away or outside of the saw cylinder 12. The preferred construction is that it be about 1" away from the saw cylinder at its nearest point thereto. The plane surface 38 and the extension 50 angles about 10° from vertical toward the saw cylinder 12. Therefore, a vertical downward line from the point of tangency of the plane surface 38 to the arcuate portion 36 will be about 2" away from the teeth 18 of the saw cylinder 12. Therefore, a vertical seed discharge passageway or shaft 56 is formed between the surface 38 with extension 50 and the saw cylinder 12 surface.

It will be understood that in operation, the seed roll will be a mass of unginned cotton seed, partially ginned cotton seed, and ginned cotton seed mixed with lint, most of which is attached to some of the cotton seed in the roll. The covering of the comingled mass will tend to adhere together because of the comingling of the lint. Over a majority of its surface area, the seed roll 20 will be a circular arc in cross section. In fact, this will be about $\frac{2}{3}$ of a complete circle (240°) along the direction of rotation of the seed roll 20. This circular arc will begin at about the ginning point 24 of the gin ribs 22 and extend for, as stated above, about $\frac{2}{3}$ of a complete circle. At this $\frac{2}{3}$ point, the arcuate portion 36 or the scroll 32 changes to the plane surface 38; and therefore, at this point, the seed roll will form a lobe 52 thereon. This lobe will be formed because the gravity will be pulling the seed down at this point as well as the centrifugal forces of the rotating mass.

It will be noted that at the gap 34, the seed roll 20 will maintain its circular shape. This is because the centrifugal force would tend for it to move horizontally at this point, but the gravity tends to pull it down, so that basically the circular shape of the gin roll is maintained at the gap 34.

The lobe 52 will extend downward along the plane surface 38 to the bottom edge 46 of the plane surface, at which point the vanes 48 will direct the lobe 52 toward the saw teeth 18. At the saw teeth, the engagement of the saws discs 14 and the teeth 18 with the lobe 52 of the seed roll 20 will cause the seed roll to curve upward and move along with the teeth 18 as they project above the gin ribs 22 to the ginning point 24 wherein the seed roll 20 will again be carried along in its circular pattern.

The lobe is permitted to drop down and form an arcuate bottom bight 54 which has a small radius of curvature, and which itself, almost causes a rupture of the mass of seed and lint which forms the cohesive seed roll 20. The vanes 48 are spaced apart sufficiently so that the bight 54 between the vanes 48 is permitted to rupture at this point so as to discharge the gin seed into the vertical seed discharge shaft 56. The majority of the mass which was the seed roll 20 is directed to the teeth 18 in a ruptured state. Therefore, the ginned seed will readily fall either before reaching the gin teeth through the discharge shaft 56 or pass between the gin teeth to be conveyed to a place of collection of the seed.

The embodiment shown and described above is only exemplary. I do not claim to have invented all the parts, elements or steps described. Various modifications can be made in the construction, material, arrangement, and operation, and still be within the scope of my invention.

The restrictive description and drawing of the specific examples above do not point out what an infringement of this patent would be, but are to enable one skilled in the art to make and use the invention. The limits of the invention and the bounds of the patent protection are measured by and defined in the following claims.

H. SUBJECT MATTER CLAIMED FOR PROTECTION

I claim as my invention:

1. The method of operating a cotton gin, said cotton gin having:

a. a front, a top, and a bottom,
b. a circular saw cylinder journaled for rotation about a horizontal axis,
c. circular saw discs on the saw cylinder spaced less than $\frac{5}{8}$" apart,
d. box structure forming a cylindrical roll box within which a seed roll will rotate in a direction of roll rotation,
e. gin ribs forming a portion of said box structure, and
f. a ginning point on each of said ribs;
g. wherein the improved method of operation comprises:

h. forming a cohesive mass of ginned seed and seed cotton and lint into a seed roll within said box structure having basically a circular arc in cross-section, i. causing a lobe to form on the bottom surface of said seed roll, j. directing said lobe toward said saw cylinder by seed vanes, k. said seed vanes spaced apart at least about 1.75", thereby l. rupturing said seed roll between said vanes.

2. The invention as defined in claim 1, further comprising:

m. dropping ginned seed from the rupture in the cohesive mass in front of the saw cylinder.

3. A cotton gin having:

a. a circular saw cylinder journaled for rotation about a horizontal axis, b. circular saw discs on the saw cylinder having a saw disc spacing of less than $\frac{5}{8}$", c. box structure forming a cylindrical roll box within which a seed roll will rotate in a direction of roll rotation, d. gin ribs forming a portion of said box structure, and e. a ginning point on each of said ribs;

f. wherein the improved structure comprises:

g. said cylindrical box structure forming a seed roll having basically a circular arc cross section for about $\frac{2}{3}$ of a complete circle from the ginning points, h. said box structure having a plane surface tangential to said circular arc extending downward angled toward the saw cylinder, j. said plane surface having a bottom edge above the saw cylinder axis, k. an extension of said plane surface spaced away from said saw cylinder, thus forming a vertical seed discharge shaft between i. the plane surface with its extension, and ii. the saw cylinder, m. a finger shaft mounted on said box structure at the bottom edge of the plane surface, n. vanes on the finger shaft extending partially into the vertical seed discharge shaft toward the saw cylinder, and o. said vanes being spaced apart a distance at least three times the saw disc spacing.

4. The invention as defined in claim 3 further comprising:

p. said vanes spaced along said finger shaft at least about 1.75" and not more than about 3" on center.

5. The invention as defined in claim 3 further comprising:

p. the vertical seed discharge shaft width as measured by the distance of the extension of said plane surface from said saw cylinder at its nearest point being at least about 1", and q. said plane surface and said extension thereof angled toward said saw cylinder at about 10° from vertical.

6. The invention as defined in claim 5 further comprising:

r. said vanes spaced on said finger shaft at least about 1.75" and not more than about 3".

* * * * *